United States Patent [19]

Winter et al.

[11] 4,131,537

[45] Dec. 26, 1978

[54] NAPHTHA HYDROFINING PROCESS

[75] Inventors: William E. Winter, Baton Rouge, La.; Mamerto G. Luzarraga, Summit, N.J.

[73] Assignee: Exxon Research & Engineering Co., Florham Park, N.J.

[21] Appl. No.: 839,161

[22] Filed: Oct. 4, 1977

[51] Int. Cl.[2] ..... C10G 23/02; B01J 23/88

[52] U.S. Cl. ..... 208/216; 208/80; 208/255; 208/264; 252/477 R; 260/677 A

[58] Field of Search ..... 208/216, 255; 260/677 A, 677 H

[56] References Cited

U.S. PATENT DOCUMENTS

| | | | |
|---|---|---|---|
| 3,471,400 | 10/1969 | Cosyns et al. | 208/255 |
| 3,472,763 | 10/1969 | Cosyns et al. | 208/143 X |
| 3,691,066 | 9/1972 | Carruthers et al. | 208/217 X |
| 3,751,497 | 8/1973 | Schwerdtel et al. | 260/666 A |
| 3,787,514 | 1/1974 | Bernusset | 260/677 H |
| 3,812,057 | 3/1974 | Morgan et al. | 252/416 |
| 4,042,490 | 8/1977 | Suggitt et al. | 208/264 |
| 4,059,504 | 11/1977 | Bauer | 208/255 |
| 4,070,272 | 1/1978 | Rausch | 208/217 |

*Primary Examiner*—Delbert E. Gantz
*Assistant Examiner*—G. E. Schmitkons
*Attorney, Agent, or Firm*—Llewellyn A. Proctor

[57] ABSTRACT

A hydrofining process wherein an olefinic naphtha hydrocarbon feed in vapor phase is contacted, in a fixed bed, with a catalyst of small particle size at low pressure. Suitably, a catalyst of average particle size no greater than, or less than about 1/20 inch is employed. Preferably, the catalyst is of average particle size ranging from about 200 microns to about 1/20 inch, and more preferably the catalyst is of average particle size ranging from about 1/40 inch to about 1/20 inch. By the use of such catalyst at total pressures ranging from about 60 to about 300 psig, preferably from about 80 to about 200 psig, it has been found that the rate of hydrodesulfurization of the naphtha feed is considerably increased, and yet there is significantly less saturation of the olefins, and other nonreactive hydrocarbons with hydrogen.

19 Claims, No Drawings

NAPHTHA HYDROFINING PROCESS

Hydrotreating processes, or processes for treating hydrocarbon stocks in the presence of catalysts are well known in the petroleum refining industry. Hydrodesulfurization, one such type of process, refers to the treatment of residual fuels. Hydrofining, another type of hydrotreating process, refers to the treatment, or catalytic hydrogenation of solvents and disillate fuels. Hydrofining is employed to remove sulfur, nitrogen and other non hydrocarbon components, as well as to improve the odor, color, stability, engine cleanliness and combustion characteristics, and other important quality characteristics. When applied for processing catalytic cracking feedstocks, hydrofining significantly reduces carbon yield, increases gasoline yield, and improves the quality of the catalytic cracking stocks (cat naphthas).

The catalysts employed in hydrofining are comprised of composites of Group VIB or Group VIII metal hydrogenating (hydrogen transfer) components, or both, with an inorganic oxide base, or support, typically alumina. Typical catalysts are molybdena on alumina, cobalt molybdate on alumina, nickel molybdate on alumina or nickel tungstate. The specific catalyst used depends on the particular application. Cobalt molybdate catalyst is often used when sulfur removal is the primary interest. The nickel catalysts find application in the treating of cracked stocks for olefin or aromatic saturation. Sweetening (removal of mercaptans) is a preferred application for molybdena catalysts.

Three basic types of hydrocarbon reactions occur in processing feeds during hydrofining; a first which involves removal of sulfur by hydrodesulfurization (sulfur being eliminated in the form of hydrogen sulfide), a second which involves the removal of oxygen to improve stability and combustion characteristics, and a third involving the saturation of olefins and aromatics compounds with hydrogen. As to the first type, essentially four types of sulfur containing compounds, i.e., mercaptans, disulfides, thiophenes and benzothiophenes, are involved in the hydrodesulfurization reactions. The mercaptans and disulfide types are representative of a high percentage of the total sulfur found in the lighter virgin oils, such as virgin naphtha and heating oil. The thiophenes and benzothiophenes generally appear as the predominant sulfur form in heavy virgin oils and in cracked stocks of all boiling ranges. In the type of reaction involving oxygen removal, hydrogen reacts with oxygen compounds; condensation of the hydroxyl groups with hydrogen forming water. The removal of oxygen provides stable and clean burning fuels, and the hydrofinates are generally free of oxygen compounds. Hydrofining also improves stability by saturating olefins, and other reactive hydrocarbons as well as oxygen containing compounds.

Saturation of olefins and aromatic compounds, however, is not always desired. In the production of Mogas, for example, the saturation of the olefins or aromatics invariably reduces the octane number of the product. Albeit, at the hydrofining severities required for gasoline desulfurization, aromatics saturation does not occur to an appreciable extent, olefins are readily saturated to paraffins of lower octane value. Historically, therefore, the hydrofining of gasoline to reduce the sulfur content and thereby improve lead susceptability has resulted in decreased octane values. Moreover, hydrogen is expensive and its excess use is not only wasteful, but adversely affects product quality. In fact, product quality is generally reduced by excessive reaction with hydrogen. For example, hydrofining is the best process available for desulfurizing cat naphthas, these being major blending components in the Mogas pool because of their high olefin and aromatics content. This process, however, despite its capability of reducing sulfur, adversely affects octane rating because cat naphthas contain appreciable quantities of olefins, and the saturation of olefins lowers their octane value. More stringent sulfate emission requirements (due to the level of sulfate emissions from the exhausts of automobiles equipped with catalytic converters), however, shall necessitate greater and greater Mogas desulfurization. Moreover, in addition to the sulfate emissions problem, sulfur may adversely affect new catalysts contemplated by the auto industry for more stringent 1980 hydrocarbon, carbon monoxide and $SO_x$ standards.

It is, accordingly, the primary objective of the present invention to provide an improved hydrofining process which simultaneously achieves better hydrogen economies and more effective hydrodesulfurization of naphtha hydrocarbons, especially cat naphthas.

A specific object is to provide a new and improved cat naphtha hydrofining process wherein naphthas which contain appreciable quantities of olefinic compounds can be hydrofined and hydrodesulfurized, without excessive octane loss and olefin hydrogenation.

These objects and others are achieved in accordance with the present invention embodying a hydrofining process wherein an olefinic naphtha hydrocarbon feed in vapor phase is contacted, in a fixed bed, with a catalyst of small particle size at low pressure. In particular, it relates to the use of a catalyst of average particle size no greater than, or less than about 1/20 inch, preferably to the use of a catalyst of average particle size ranging from about 200 microns to about 1/20 inch, and more preferably to the use of a catalyst of average particle size ranging from about 1/40 inch to about 1/20 inch. By the use of such catalyst at total pressures ranging from about 60 to about 300 pounds per square inch gauge (psig), and preferably from about 80 to about 200 psig, it has been found that the rate of hydrodesulfurization of the naphtha feed was considerably enhanced, or increased, while the rate of olefin hydrogenation was relatively unaffected. At such conditions there is significantly less saturation of the olefins, and other nonreactive hydrocarbons with hydrogen when the olefin naphtha is hydrofined to a given product sulfur level, as contrasted with conventional operation.

It is found, pursuant to this invention, that olefinic naphtha feeds, notably cat cracked and thermally cracked naphthas of olefin content ranging from about 10 percent to about 60 percent, more typically from about 20 percent to about 40 percent to about 40 percent (by weight), and boiling within the gasoline range, typically from about 65° F to about 430° F (i.e., $C_5$/430° F), can be hydrodesulfurized at fairly rapid rates and yet without significant olefin saturation, and loss of octane values, by contact of such feeds with catalyst of small particle size at low pressures. It is preferable, however, to split the feed into a high boiling fraction, or fraction of low olefin content, and a low boiling fraction, or fractions which are of relatively high olefin content. Suitably then, the high boiling fraction is hydrofined at high severity, and the latter fraction, or fractions, is hydrofined at mild hydrofining conditions; or where the low boiling fraction per se is divided into two fractions, the higher boiling of the two fractions is preferably hydrofined at mild conditions, and the lower boiling of the two fractions is contacted with a basic solution to remove mercaptan or disulfide sulfur compounds, or further hydrofined.

The greatest benefits of hydrofining at mild conditions are derived by the treatment of an intermediate boiling cat naphtha fraction, or fraction boiling with a lower end boiling point of from about 160° F to about 220° F, particularly from about 180° F to about 200° F, and an upper end boiling point of from about 270° F to about 350° F, particularly from about 290° F to about 330° F. Such fraction can be hydrofined at rather mild conditions with little or no significant reduction in octane value, and yet the fraction is effectively hydrodesulfurized. In accordance with the best mode of practice of this invention therefore, a whole cat naphtha is split into an intermediate boiling fraction such as described which is hydrofined at mild conditions, and lower and higher boiling fractions which are separately treated, or hydrofined, and the component products then reblended to form gasoline. Suitably, the higher end boiling point of the lower boiling fraction and the lower end boiling point of the higher boiling fraction correspond to the lower and higher end boiling points, respectively, of said intermediate boiling fraction. The lower end boiling point of the low boiling fraction ranges from about 65° F to about 120° F, preferably from about 100° F to about 110° F. The upper or high end boiling point of the high boiling fraction ranges generally from about 300° F to about 430° F, preferably from about 350° F to about 430° F. A high degree of hydrodesulfurization can be achieved by the severe hydrofining of said high boiling fraction which, because of its low olefin content is not significantly reduced in octane value. A mild hydrofining of said intermediate boiling fraction, on the other hand, significantly lowers the total sulfur content of this fraction, and there is no significant loss of octane value despite its high olefin content. The low boiling fraction can be simularly hydrofined at mild conditions without significant octane loss, and some hydrodesulfurization achieved albeit this fraction is normally low in sulfur content. Or, sulfur can be removed from the low boiling fraction by treatment with an alkaline material.

The major variables employed in hydrofining the low boiling fraction, where it is desired to hydrofine this fraction at all, are summarized as follows:

| Process Variable | Typical | Preferred |
|---|---|---|
| Pressure, psig | 60–500 | 80–200 |
| Temperature, ° F | 400–800 | 500–600 |
| Feed Rate, LHSV | 1–80 | 5–20 |
| Hydrogen Rate, SCF/Bbl | 200–4000 | 800–2000 |

The intermediate boiling fraction, suitably, is subjected to quite mild hydrofining conditions as follows:

| Process Variable | Typical | Preferred |
|---|---|---|
| Pressure, psig | 60–500 | 80–200 |
| Temperature, ° F | 400–800 | 500–600 |
| Feed Rate, LHSV | 1–80 | 2–10 |
| Hydrogen Rate, SCF/Bbl | 200–4000 | 800–2000 |

The higher boiling fraction, suitably, is subjected to quite severe hydrofining conditions as follows:

| Process Variable | Typical | Preferred |
|---|---|---|
| Pressure, psig | 80–2000 | 200–500 |
| Temperature, ° F | 400–800 | 550–650 |
| Feed Rate, LHSV | 0.2–20 | 1–5 |
| Hydrogen Rate, SCF/Bbl | 200–4000 | 800–2000 |

Low pressure hydrofining of an olefinic naphtha, notably intermediate boiling cat naphthas, in the presence of catalysts of small particle size proves an admirably satisfactory method for reducing octane losses and hydrogen consumption through decreased olefin saturation. The enhanced desulfurization selectivity achieved at these conditions is quite surprising for it would be expected that higher desulfurization rates would result at higher pressures. Catalyst particle size is found to have a strong effect on both desulfurization and hydrogenation rates. Directionally, the effect of pore diffusion on hydrofining reaction rates would be expected to increase as reactor pressure increased, since reaction rates normally increase and diffusivities decrease as pressure increases. This was true for olefins hydrogenation rates. For example, no particle size effects were observed at 180 psig, 550° F, and a treat gas rate of 800 SCF/B. At a reactor pressure of 250 psig the magnitude of these effects was small but significant while at 400 psig an increased particle size effect was observed for olefins hydrogenation reactions. On the other hand, the effect of catalyst particle size on desulfurization rate was found to increase with decreasing reactor pressure. At a given reactor temperature, treat gas rate and feed rate (LHSV), the extent of desulfurization achieved by hydrotreating was reduced as reactor pressure was reduced. Even so, this particle size effect for desulfurization reactions indicated desulfurization reaction rates increased as reactor pressure was reduced. Since olefins hydrogenation rates decreased with decreasing reactor pressure, this unexpected response of desulfurization rates to pressure provides a means for reducing octane losses and hydrogen consumption incurred in hydrotreating olefinic naphthas.

The invention will be more fully understood by reference to the following nonlimiting demonstrations and examples which present comparative data which illustrate its more salient features. All parts are given in terms of weight unless otherwise specified.

In conducting a series of runs an intermediate boiling cat naphtha fraction, or fraction boiling 200° F/330° F, was employed. The complete feedstock inspections are given in Table I, below.

Table I

| | |
|---|---|
| Gravity, ° API | 47.4 |
| Sulfur, wppm | 613 |
| Nitrogen, wppm | 16.7 |
| Br. No., cc/gm | 45.7 |
| Carbon, Wt. % | 87.24 |
| Hydrogen, Wt. % | 12.45 |
| RON | 90.5 |
| MON | 79.4 |
| FIA | |
| Arom. | 35.8 |
| Unsat. | 28.1 |
| Sat. | 36.1 |
| MS-Aromatics, Wt. % | |
| $C_{13}$ Arom. | 0 |
| $C_{12}$ Arom. | 0 |
| $C_{11}$ Arom. | 0.689 |
| $C_{10}$ Arom. | 1.291 |
| $C_9$ Arom. | 8.640 |
| $C_8$ Arom. | 12.771 |
| Toluene | 5.544 |
| Benzene | 0.112 |
| Total Alk. Benzenes | 29.048 |

Table I-continued

| | |
|---|---|
| Naphthalenes | 0.203 |
| Indans | 0.895 |
| Styrene | 0.0 |
| ASTM D-86 | |
| IBP/5% | 149/243 |
| 10/20 | 246/252 |
| 30/40 | 256/262 |
| 50/60 | 269/276 |
| 70/80 | 285/295 |
| 90/95 | 308/318 |
| FBP | 367 |

The runs were conducted in a series of reactors heated in a common sandbath. Each reactor was constructed of ½ inch schedule 80 stainless steel pipe, and each was equipped with a separate and independent feed burette, feed pump, pressure regulator system, treat gas flow control and metering system, and product accumulator. Each was provided with side entering thermocouples. The top couple was located at the end of a short bed of mullite (fused alumina) used as a preheat zone; the other three couples being placed in the catalyst bed. The catalyst beds were diluted with mullite to provide better transfer of the heat released by olefins hydrogenation to the sandbath and thus maintain a relatively flat reactor temperature profile, and to provide sufficient catalyst bed length to avoid axial dispersion effects. It was found that overall catalyst packing densities for these staged dilutions methods were considerably less than normal for an undiluted bed and consequently, reactor changing was accomplished by specifying catalyst weight rather than volume. All data obtained is maintained on a consistent basis, all space velocities having been adjusted to a 0.75 gm/cc catalyst packing density basis.

Each reactor was charged with a catalyst as identified in Table II below:

TABLE II

| | Catalyst Inspections | |
|---|---|---|
| | A | B |
| Catalyst Description | 1/16" $CoMo/Al_2O_3$ Extrudate | Catalyst A Crushed to 14/35 Mesh (Tyler; 1/32 inch average Particle diameter |
| Surface Area $m^2/gm$ | 276 | 280 |
| Pore Volume, $cc^3/gm$ | 0.5 | 0.52 |
| CoO, Wt. % | 4.0 | 4.1 |
| $MoO_3$, Wt. % | 12.1 | 11.0 |

The catalysts were then activated. In activation of the catalyst, in preparation for a run, the following procedures were carried out, to wit:

The catalyst was calcined at 900° F for 3 hours in air. The reactors were charged with the catalyst, then heated to 400° F at atmospheric pressure under nitrogen flow, and dried overnight. Each reactor was then cooled to 250° F under nitrogen flow. The nitrogen flow was then stopped, and a stream containing 10% $H_2S$-in-hydrogen was introduced at atmospheric pressure to sulfide the catalyst. The sulfiding temperature was increased to 450° F at the rate of 50° F/hour, and the temperature maintained at 450° F overnight. The sulfiding temperature was then increased to 650° F at a rate of 50° F/hr, and held overnight. Reactor temperatures were then decreased to 300° F and then feed and hydrogen were introduced to initiate the reaction.

The reactors were each then charged with the feed, and hydrogen, and the feed hydrofined at, i.e., different severity levels, at 550° F and 800 SCF/Bbl at 400 psig and 180 psig, respectively, to produce products with different sulfur levels. The results are given in Examples 1 through 3.

EXAMPLE 1

The intermediate cat naphtha fraction described in Table I was hydrotreated using catalysts A and B of Table II at 400 psig reactor pressure. As shown in Table III below, the sulfur concentration of this naphtha was reduced to 9 wppm with both catalysts. The extent of olefins hydrogenation incurred in hydrotreating, as measured by bromine number reduction, was somewhat higher with Catalyst B, the smaller sized particle, than with Catalyst A. These data indicate that catalytic desulfurization rates were relatively unaffected by pore diffusion at these relatively severe naphtha hydrotreating conditions. Olefins hydrogenation rates, however, were affected to some degree by pore diffusion effects.

TABLE III

| Cat Naphtha Hydrotreating 200/330° F Cat Nahtha, 400 psig, 550° F, 800 SCF/B | | |
|---|---|---|
| | Catalyst A | Catalyst B |
| LHSV | 6 | 6 |
| Product Sulfur, ppm | 9 | 9 |
| Product Bromine No., cg/gm | 14 | 12 |

EXAMPLE 2

The same intermediate boiling cat naphtha feed was hydrotreated with Catalysts A and B at 180 psig. As shown in Table IV below, at a space velocity of 5 LHSV the extent of olefins hydrogenation measured during the hydrotreating process was the same for both catalysts. As a result of this olefins hydrogenation, the octane rating of both hydrotreated cat naphtha products were less than the octane rating of the unhydrotreated feed. The degree of desulfurization produced by Catalyst B, the smaller sized catalyst was substantially higher than that afforded by the larger sized Catalyst A.

TABLE IV

| Cat Naphtha Hydrotreating 200/300° F Cat Naphtha, 180 psig, 550° F, 800 SCF/B | | |
|---|---|---|
| | Catalyst A | Catalyst B |
| LHSV | 5 | 5.1 |
| Product Sulfur, ppm | 28 | 10 |
| Product Bromine No., cg/gm | 31 | 30 |
| Product RON | 85.4 | 85.8 |

These data further indicate that olefins hydrogenation rates were relatively unaffected by pore diffusion rates. The higher degree of desulfurization afforded by the smaller sized Catalyst B indicated that desulfurization rates were strongly affected by catalyst pore diffusion even though the hydrotreating process if this example was less severe than the process of Example 1. Moreover, the degree of desulfurization achieved in this example was less than at 400 psig and a higher space velocity, or LHSV.

EXAMPLE 3

The cat naphtha feed, heretofore described, was again hydrotreated with both catalysts at a pressure of 180 psig but at a higher space velocity. As in the previous example, olefins hydrogenation rates were relatively unaffected by catalyst particle size while, as shown in Table V below, the degree of desulfurization afforded by Catalyst B was substantially higher than with the larger sized catalyst.

TABLE V

Cat Naphtha Hydrotreating
200/330° F Cat Naphtha, 180 psig, 500° F, 800 SCF/B

| | Catalyst A | Catalyst B |
|---|---|---|
| LHSV | 6.7 | 6.8 |
| Product Sulfur, ppm | 45 | 29 |
| Product Bromine No., cg/gm | 34 | 34 |
| Product RON | 86.9 | 87.0 |

These data, and that of Example 2 illustrate the reduction in olefins saturation and octane losses which can be accomplished by the practice of this invention. If, for instance, it were necessary to desulfurize the cat naphtha described in Table I to the 30 wppm level, it would be preferable to obtain this desulfurization at 180 psig rather than 400 psig. At 550° F and 800 SCF/B, it would be necessary to utilize a space velocity of 5 LHSV with Catalyst A to achieve the 30 ppm sulfur level. With Catalyst B, however, the same product sulfur would be accomplished at a higher space velocity, i.e., 6.8 LHSV. Since the extent of olefins hydrogenation measured with Catalyst A at 5 LHSV was greater than with Catalyst B at 6.8 LHSV, the octane penalty for hydrotreating at 180 psig to 30 wppm product sulfur with Catalyst B was substantially less than with the larger size Catalyst A. In this instance use of the smaller size catalyst particle was equivalent to a 1.5 RON savings.

It is apparent that the present invention is susceptable to various modifications and changes which can be made without departing its spirit and scope.

Having described the invention, what is claimed is:

1. A process for hydrofining an olefinic naphtha hydrocarbon feed which comprises contacting said feed in vapor phase, and hydrogen, with a fixed bed of particulate catalyst comprised of a composite of a Group VIB or Group VIII metal, or both, and an inorganic oxide support, of average size below about 1/20 inch diameter at pressure ranging from about 60 psig to about 300 psig.

2. The process of claim 1 wherein the feed is comprised of a cat cracked or thermally cracked naphtha of olefin content ranging from about 10 percent to about 60 percent, based on the weight of said feed.

3. The process of claim 2 wherein the olefin content ranges from about 20 percent to about 40 percent.

4. The process of claim 1 wherein the feed boils from about $C_5$/430° F.

5. The process of claim 1 wherein the feed has a low end boiling point ranging from about 160° F to about 220° F and a high end boiling point ranging from about 270° F to about 350° F.

6. The process of claim 5 wherein the major process variables employed in processing said feed are substantially as follows:

| | |
|---|---|
| Pressure, psig | 60–500 |
| Temperature, ° F | 400–800 |
| Feed Rate, LHSV | 1–80 |
| Hydrogen Rate, SCF/Bbl | 200–4000 |

7. The process of claim 5 wherein the major process variables employed in processing said feed are substantially as follows:

| | |
|---|---|
| Pressure, psig | 80–200 |
| Temperature, ° F | 500–600 |
| Feed Rate, LHSV | 2–10 |
| Hydrogen Rate, SCF/Bbl | 800–2000 |

8. The process of claim 5 wherein the low end boiling point ranges from about 180° F to about 200° F and the high end boiling point ranges from about 290° F to about 330° F.

9. The process of claim 8 wherein the major process variables employed in processing said feed are substantially as follows:

| | |
|---|---|
| Pressure, psig | 60–500 |
| Temperature, ° F | 400–800 |
| Feed Rate, LHSV | 1–80 |
| Hydrogen Rate, SCF/Bbl | 200–4000 |

10. The process of claim 8 wherein the major process variables employed in processing said feed are substantially as follows:

| | |
|---|---|
| Pressure, psig | 80–200 |
| Temperature, ° F | 500–600 |
| Feed Rate, LHSV | 2–10 |
| Hydrogen Rate, SCF/Bbl | 800–2000 |

11. The process of claim 1 wherein the olefinic naphtha hydrocarbon feed is split into three fractions, a low boiling fraction having an initial boiling point ranging from about 65° F to about 120° F and an upper boiling point ranging from about 160° F to about 220° F, an intermediate boiling fraction having an initial boiling point ranging from about 160° F to about 220° F and an upper boiling point ranging from about 270° F to about 350° F, and a high boiling fraction having an initial boiling point ranging from about 270° F to about 350° F and an upper boiling point ranging from about 300° F to about 430° F, wherein the intermediate boiling fraction is hydrofined at the following conditions

| | |
|---|---|
| Pressure, psig | 60–500 |
| Temperature, ° F | 400–800 |
| Feed Rate, LHSV | 1–80 |
| Hydrogen Rate, SCF/Bbl | 200–4000 |

and the higher boiling fraction is hydrofined at the following conditions

| | |
|---|---|
| Pressure, psig | 80–2000 |
| Temperature, ° F | 400–800 |
| Feed Rate, LHSV | 0.2–20 |
| Hydrogen Rate, SCF/Bbl | 200–2000 |

12. The process of claim 11 wherein the low boiling fraction is hydrofined at the following conditions

| | |
|---|---|
| Pressure, psig | 60–500 |
| Temperature, ° F | 400–800 |
| Feed Rate, LHSV | 1–80 |
| Hydrogen Rate, SCF/Bbl | 200–4000 |

13. The process of claim 11 wherein the low boiling fraction is hydrofined at the following conditions

| | |
|---|---|
| Pressure, psig | 80–200 |
| Temperature, ° F | 500–600 |
| Feed Rate, LHSV | 5–20 |
| Hydrogen Rate, SCF/Bbl | 800–2000 |

the intermediate fraction is hydrofined at the following conditions

| | |
|---|---|
| Pressure, psig | 80–200 |
| Temperature, ° F | 500–600 |
| Feed Rate, LHSV | 2–10 |
| Hydrogen Rate, SCF/Bbl | 800–2000 |

and the high boiling fraction is hydrofined at the following conditions

| | |
|---|---|
| Pressure, psig | 200–500 |
| Temperature, ° F | 550–650 |
| Feed Rate, LHSV | 1–5 |
| Hydrogen Rate, SCF/Bbl | 800–2000 |

14. The process of claim 1 wherein the catalyst is comprised of a composite of an admixture of Group VIB and Group VIII metals with alumina.

15. The process of claim 14 wherein the catalyst is comprised of cobalt molybdate or nickel molybdate on alumina.

16. The process of claim 1 wherein the particle size of the catalyst ranges from about 200 microns to about 1/20 inch.

17. The process of claim 1 wherein the particle size of the catalyst ranges from about 1/40 inch to about 1/20 inch.

18. A process for hydrofining an olefinic naphtha hydrocarbon feed which comprises feed which comprises splitting said feed into three fractions, a low boiling fraction having an initial boiling point ranging from about 65° F to about 120° F and an upper boiling point ranging from about 160° F to about 220° F, an intermediate boiling fraction having an initial boiling point ranging from about 160° F to about 220° F and an upper boiling point ranging from about 270° F to about 350° F, and a high boiling fraction having an initial boiling point ranging from about 270° F to about 350° F and an upper boiling point ranging from about 300° F to about 430° F, contacting said feed having a low end boiling point ranging from about 160° F to about 220° F and a high end boiling point ranging from about 270° F to about 350° F in vapor phase, and hydrogen, with a fixed bed of particulate catalyst comprised of a composite of cobalt molybdate or nickel molybdate on alumina, of average size below about 1/20 inch diameter, at process conditions defined substantially as follows:

| | |
|---|---|
| Pressure, psig | 60–500 |
| Temperature, ° F | 400–800 |
| Feed Rate, LHSV | 1–80 |
| Hydrogen Rate, SCF/Bbl | 200–4000 |

19. The process of claim 18 wherein the olefinic naphtha hydrocarbon feed is split into three fractions, a low boiling fraction having an initial boiling point ranging from about 65° F to about 120° F and an upper boiling point ranging from about 160° F to about 220° F, an intermediate boiling fraction having an initial boiling point ranging from about 160° F to about 220° F and an upper boiling point ranging from about 270° F to about 350° F, and a high boiling fraction having an initial boiling point ranging from about 270° F to about 350° F and an upper boiling point ranging from about 300° F to about 430° F, wherein the low boiling fraction is hydrofined at the following conditions:

| | |
|---|---|
| Pressure, psig | 60–500 |
| Temperature, ° F | 400–800 |
| Feed Rate, LHSV | 1–80 |
| Hydrogen Rate, SCF/Bbl | 200–4000 |

wherein the intermediate boiling fraction is hydrofined at the following conditions:

| | |
|---|---|
| Pressure, psig | 60–500 |
| Temperature, ° F | 400–800 |
| Feed Rate, LHSV | 1–80 |
| Hydrogen Rate, SCF/Bbl | 200–4000 |

and the higher boiling fraction is hydrofined at the following conditions:

| | |
|---|---|
| Pressure, psig | 80–2000 |
| Temperature, ° F | 400–800 |
| Feed Rate, LHSV | 0.2–20 |
| Hydrogen Rate, SCF/Bbl | 200–2000 |

* * * * *